United States Patent [19]

Hughes et al.

[11] Patent Number: 4,620,461

[45] Date of Patent: Nov. 4, 1986

[54] SCREW DRIVING TOOL

[76] Inventors: William J. Hughes, 1021 Rogers Cir. #4, Boca Raton, Fla. 33431; Franklin R. Wheelock, 1413 S.W. 74th Ave., North Lauderdale, Fla. 33068

[21] Appl. No.: 780,164

[22] Filed: Sep. 26, 1985

[51] Int. Cl.[4] ..... B25B 13/16

[52] U.S. Cl. ..... 81/461; 81/436

[58] Field of Search ..... 81/461, 436

[56] References Cited

U.S. PATENT DOCUMENTS

| | | | |
|---|---|---|---|
| 697,836 | 4/1902 | Gorham | 81/436 |
| 1,538,195 | 5/1925 | Levedahl | 81/436 |
| 4,016,912 | 4/1977 | St-Amour | 81/436 |

FOREIGN PATENT DOCUMENTS

| | | | |
|---|---|---|---|
| 2524995 | 12/1976 | Fed. Rep. of Germany | 81/436 |

*Primary Examiner*—Frederick R. Schmidt

*Assistant Examiner*—Joseph T. Zatarga

*Attorney, Agent, or Firm*—Zarley, McKee, Thomte, Voorhees & Sease

[57] ABSTRACT

The device for driving a screw comprises an elongated body having a shank at one end and a blade at the other end. The blade has a pair of opposite side edges, an end edge, and a pair of front and rear flat faces. The faces of the blade are spaced apart from one another adjacent the end edge a predetermined distance which is sized to permit the end edge to fit within the elongated slot of a screw. A pair of elongated flanges extend along the side edges of the blade and each have one end forming a tip which protrudes axially beyond the end edge of the blade. The tips of the flanges also include flat portions which extend perpendicularly to the front and rear faces of the blade so that the tips of the flanges will engage the peripheral edges of the screw head when the end of the blade is within the slot, thereby holding the blade against longitudinal movement within the slot.

1 Claim, 6 Drawing Figures

SCREW DRIVING TOOL

BACKGROUND OF THE INVENTION

This invention relates to a toil for handling conventional slotted screws.

Difficulty has been encountered in the tools presently used for driving slotted screws. One problem which has been encountered is that the screw driver which fits within the slot of the screw often slides longitudinally out of the slot during the time that it is being used to drive the screw.

Various efforts have been made to try to overcome the problems encountered in driving a slotted screw with a conventional screw driver. The common goal has been to eliminate the sliding out of the screw driver from the slotted head. Various other types of screws have been used, such as the Phillips head screw and the hex head screw. Screw drivers used with the Phillips head, however, often cam out of the X-shaped slot in the Phillips head. Tools for rotating the hex type of screw often slip around the head and create damage to either the tool or the hex type head.

Therefore, a primary object of the present invention is the provision of an improved screw driving tool for driving slotted screws.

A further object of the present invention is the provision of an improved screw driving tool which includes means thereon for retentively holding the tool in engagement with the screw head and for preventing the sliding out of the tool from the slot in the screw head.

A further object of the present invention is the provision of a tool having means thereon for engaging the screw head to hold the tool against longitudinal movement within the screw slot.

A further object of the present invention is the provision of a device which is simple in construction, efficient in operation and easy to use.

SUMMARY OF THE INVENTION

The screw driving tool of the present invention includes a shank having a flat blade portion at the lower end thereof. The flat blade includes an end edge which is sized to fit within the slot in a conventional slotted screw. Extending along the sides of the blade are a pair of flanges which protrude a short distance beyond the end edge of the blade. The side flanges also have flat portions which extend perpendicularly from the front and rear faces of the screw blade.

When the tool is used to engage a screw, the end edge is placed within the slot of the screw. The side flanges, because they protrude beyond the end edge, extend downwardly over the sides of the screw head so as to hold the tool against longitudinal movement within the slot of the screw. Preferably the flat portions of the flanges extend in opposite directions from the front and rear faces of the blade so as to embrace the sides of the screw head during the time that the screw head is being rotated.

The result of the present invention is a positive screw head enclosure while the screw is being driven by a downward external force. The external force can be applied manually as in the case with manual screw drivers, or can be applied mechanically as in the case of power screw drivers without the fear of the blade sliding out during the driving operation.

DETAILED DESCRIPTION OF THE PREFERRED EMBODIMENT

Figure 1:
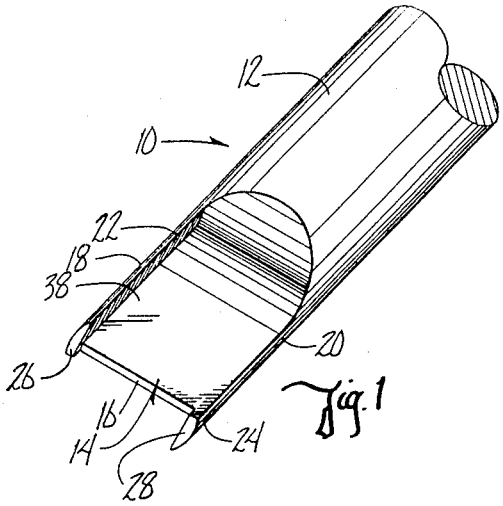
FIG. 1 is a perspective view of the end of the tool of the present invention.

Referring to the drawings, the numeral 10 generally designates the tool of the present invention. Tool 10 includes a cylindrical shank portion 12 and a blade portion 14. Blade portion 14 includes an end edge 16 which is straight and which extends transversely to the longitudinal axis of tool 10. Blade 14 also includes side edges 18, 20, each of which is provided with a side flange 22, 24, respectively. Side flanges 22, 24 extend parallel to the longitudinal axis of tool 12, and terminate in lower ends or tips 26, 28. Tips 26, 28 protrude downwardly beyond end edge 16, so as to form shoulders 30, 32 facing inwardly toward one another.

Figure 2:
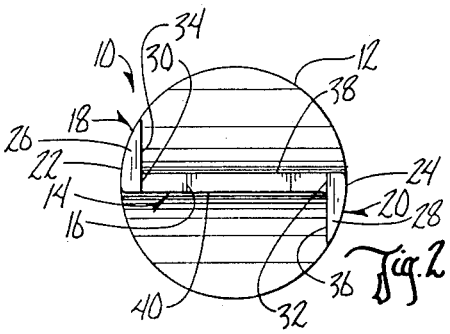
FIG. 2 is an end view of the tool of the present invention.
Figure 3:
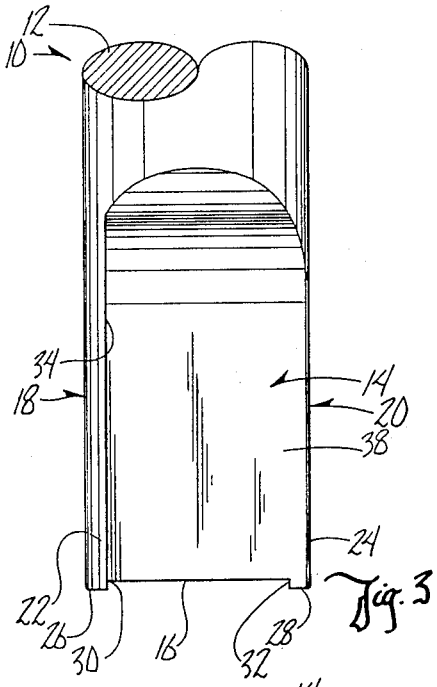
FIG. 3 is an enlarged front elevation of the end of the tool of the present invention.
Figure 4:
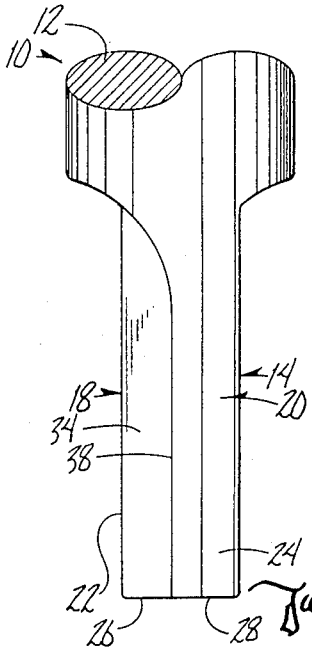
FIG. 4 is a side view of the tool shown in FIGS. 1–3.
Figure 6:
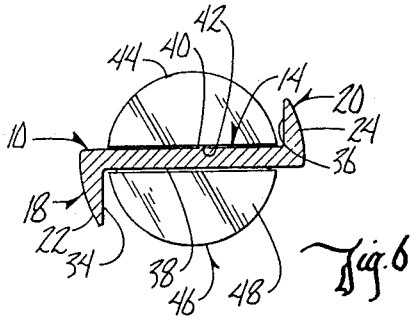
FIG. 6 is a sectional view taken along line 6—6 of FIG. 5.

As can be seen in FIGS. 1, 2 and 6, side flanges 22, 24 include flat surfaces 34, 36 which extend perpendicularly to the front and rear flat surfaces 38, 40 of blade portion 14.

The thickness of blade portion 14 adjacent end edge 16 is sized so as to correspond to the width of a slot 42 in the head 44 of a screw designated generally by the numeral 46. Screw head 44 includes a flat upper surface 48 which is circular in configuration.

Figure 5:
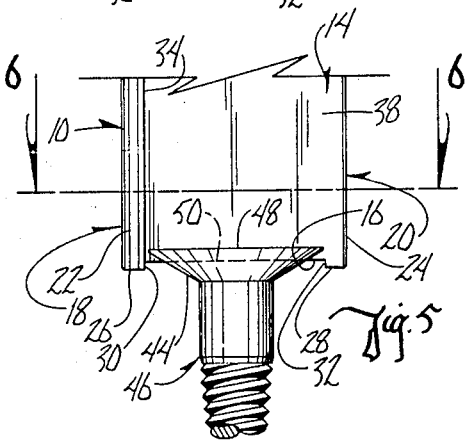
FIG. 5 is a front elevational view showing the fitting of the tool within the slot of a conventional screw.

As can be seen in FIGS. 5 and 6, the tool of the present invention is applied to the screw 46 by placing end edge 16 of blade 14 within the elongated slot 42 of screw head 44. In this position, the shoulders 30, 32 extend downwardly below the upper flat surface 48 of screw head 44. They also extend downwardly below the bottom wall (designated 50) of groove 42. As can be seen in FIG. 6, the flat surfaces 34, 36 of flanges 22, 24 embrace the peripheral edges of screw head 44 therebetween so as to hold the blade portion 14 against longitudinal movement within slot 42 of screw head 44. Thus, during the application of rotational force to the screw 46 by means of tool 10, the flanges 22, 24 prevent the screw head from sliding out of the slot 42. This is also facilitated by virtue of the fact that shoulders 30, 32 embrace the opposite ends of slot 42, again contributing to the prevention of longitudinal movement of blade 14 in slot 42.

The result of applicant's invention is a positive screw head enclosure for enclosing the screw while it is being driven down by a downward external force. This force can be applied manually as in the case of manual screw drivers, or mechanically with power screw or torque drivers without the fear of the blade sliding out of the slot and causing damage to parts surrounding the screw or to the operator's hands.

While the flanges 22, 24 are shown extending in opposite directions from one another, they can extend in the same direction or extend outwardly from both sides of front and back surfaces 38, 40 without detracting from the invention. The device is simple in construction, and efficient in use, and therefore it is believed to accomplish all of the above stated objectives.

What is claimed is:

1. A device for driving a screw having a head with opposite peripheral edges, an elongated slot extending across said head between said opposite peripheral edges, said device comprising:

an elongated cylindrical-shaped body member having a longitudinal axis and an outer cylindrical surface, a shank cylindrical-shaped portion at one end thereof, and a blade portion at the other end thereof;

said blade portion having a pair of opposite side edges extending in generally the same direction as said longitudinal axis, an end edge extending transversely of said longitudinal axis;

said blade portion further having a flat front face and a flat rear face spaced apart from one another and extending between said side edges and said end edge, the space between said front and rear faces adjacent said end edge being of a predetermined distance which is sized to permit said end edge to fit within said elongated slot of said screw;

a pair of elongated side flanges comprising extensions of said outer cylindrical surface of said body member, and extending along said side edges of said blade portion, said side flanges each having one end forming a tip which protrudes axially beyond said end edge of said blade portion, said body member, said shank portion, said blade portion, and said side flanges being of unitary construction;

said tips of side flanges also including a flat portion which extends perpendicular to said front and rear faces of said blade portions, said flat portions of said flange tips protruding perpendicularly from only said front face of said blade portion and the other of said flat portions of said flange tips protrudes perpendicularly from only said rear faces of said blade portion, whereby said tips of said flanges will engage said peripheral edges of said screw head when said end edge of said blade portion is within said slot, thereby holding said blade portion against longitudinal movement within said slot.

* * * * *